US005248152A

United States Patent [19]

Timmerman

[11] Patent Number: 5,248,152

[45] Date of Patent: Sep. 28, 1993

[54] FOOTSTEP MIMIC GAME

[76] Inventor: John R. Timmerman, 3345 Alma St., Palo Alto, Calif. 94306

[21] Appl. No.: 909,914

[22] Filed: Jul. 7, 1992

[51] Int. Cl.[5] ..... A63F 9/00

[52] U.S. Cl. ..... 273/444; 273/449

[58] Field of Search ..... 273/444, 449; 434/250, 434/255

[56] References Cited

U.S. PATENT DOCUMENTS

| | | | |
|---|---|---|---|
| 1,155,273 | 9/1915 | Quade | 273/444 X |
| 1,815,443 | 7/1931 | Mitchell . | |
| 2,158,475 | 5/1939 | Montine | 35/29 |
| 2,901,838 | 9/1959 | Bovie | 35/29 |
| 3,454,279 | 7/1969 | Foley | 273/134 |
| 3,484,106 | 12/1969 | Foley | 273/1 |
| 3,558,133 | 1/1971 | Reiner et al. | 273/1 |
| 3,761,084 | 9/1973 | Dieckmann | 273/1 |
| 3,879,034 | 4/1975 | Petrusek | 273/444 |
| 4,009,880 | 3/1977 | Lammersen | 273/444 |
| 5,156,409 | 10/1992 | Barnes | 273/444 |

FOREIGN PATENT DOCUMENTS

| | | |
|---|---|---|
| 2440586 | 6/1978 | France . |
| 410482 | 3/1963 | Switzerland . |

OTHER PUBLICATIONS

Recreation, Sports & Leisure, Oct. 1984, p. 27 Poly Pads.

*Primary Examiner*—Paul E. Shapiro

*Attorney, Agent, or Firm*—Townsend and Townsend Khourie and Crew

[57] ABSTRACT

A game employs a number of footprint markers which the players take turns laying down. The procedure of the game is that two footprints are laid down initially; the first player steps on them without stepping elsewhere, then places another footprint any place of choice. The player laying the footprint must then step in that footprint without losing balance, or the footprint is retrieved and does not count. Play continues in rotation, with each player attempting to traverse the current trail and add a new footprint, until a trail of predetermined length has been formed. The next player to step in all existing footprints in order, without losing balance, is the winner.

3 Claims, 2 Drawing Sheets

FOOTSTEP MIMIC GAME

BACKGROUND OF THE INVENTION

This invention relates generally to games. More specifically, it relates to a method and apparatus for playing a game of skill and physical coordination.

SUMMARY OF THE INVENTION

The method and apparatus of the present invention provide a game of skill and coordination suitable for players of all ages, which may be played by any number of players, indoors or out. The game apparatus comprises a number of position markers indicating a limb extremity. In the preferred embodiment the position markers are a group of numbered markers in the general shape of a footstep silhouette. According to the method of the present invention, the markers are used to incrementally build a trail which each player attempts to successfully traverse. Players may only move onto markers; the basic requirement for successfully moving onto a marker is that the player not lose balance and step or place a hand elsewhere. The trail is built from an initial marker up to a predetermined number of markers, after which the first player to successfully traverse the complete trail is the winner of the game.

Each player attempts in turn to traverse the current trail. Any mistake results in the end of the player's turn. When a player has successfully traversed the current trail, they may attempt to extend it, while still poised at the last marker of the trail, by placing an additional marker and successfully moving onto it without losing balance and stepping elsewhere. If the player does not successfully move onto the newly added marker and thus validate it, the newly added marker is removed. The player is therefore challenged to position the new marker so as to be difficult without being impossible.

In one embodiment, position markers are provided to indicate any of left-hand, right-hand, left-foot, and right-foot. The player must move the indicated limb onto the position marker, and upon successful traversal of the current trail a player may choose to attempt to add either a new foot position marker or a new hand position marker.

A further understanding of the nature and advantages of the invention may be realized by reference to the remaining portions of the specification and the drawings.

DESCRIPTION OF THE PREFERRED EMBODIMENT

Figure 1A:
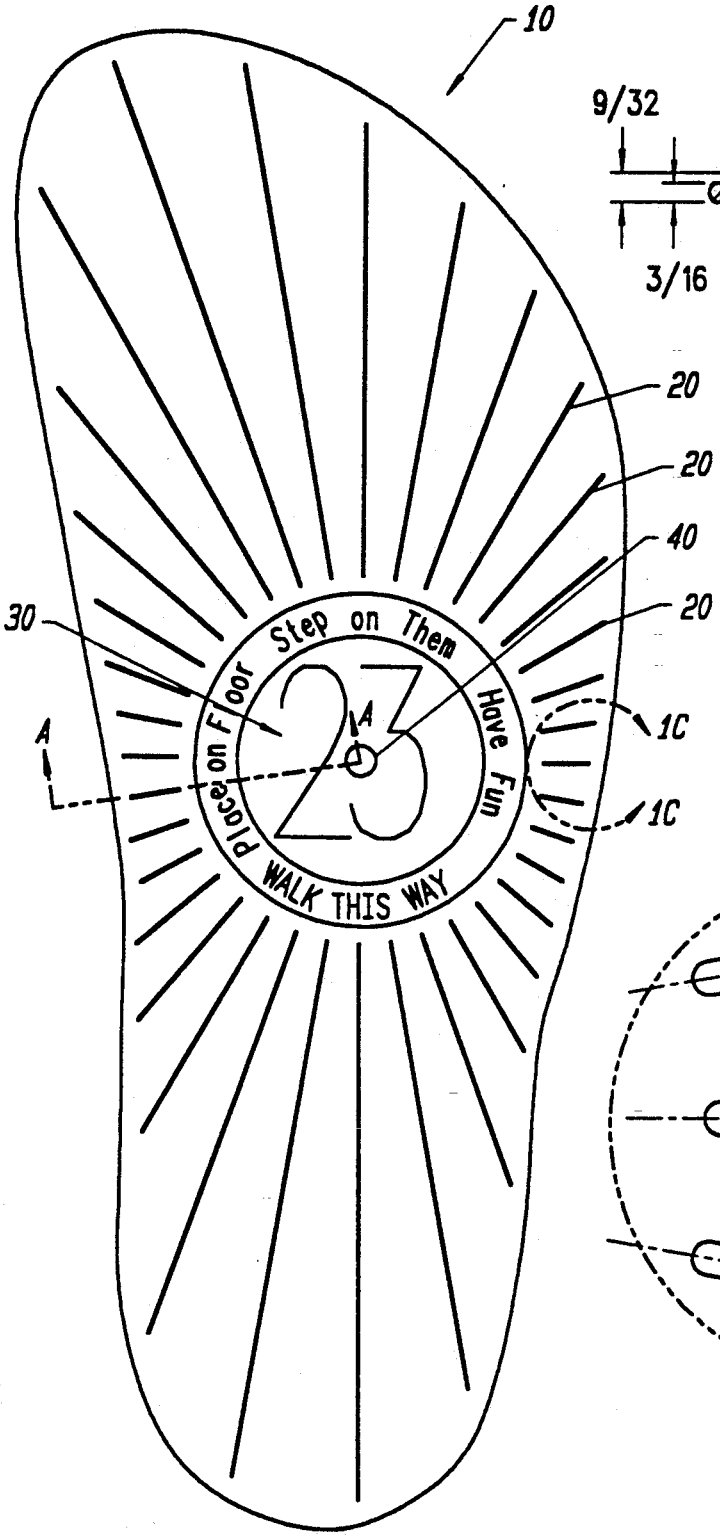
FIGS. 1A and B show a top view and a cross section view, respectively, of a foot position marker of the preferred embodiment of the present invention.
Figure 1B:
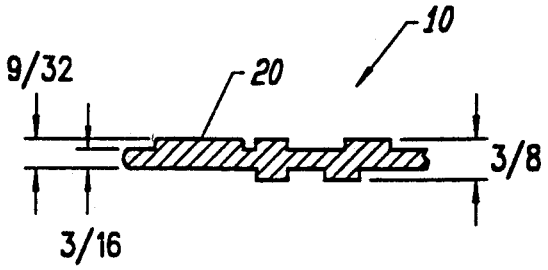
Figure 1C:
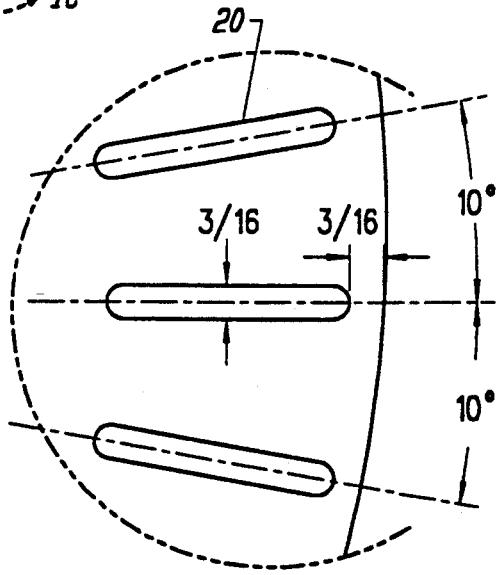

Illustrated in FIG. 1A is a foot position marker 10 of the preferred embodiment of the present invention. Position marker 10 is shaped generally as a footprint and is made of molded rubber. To improve traction, position marker 10 has thirty six radially extending ridges 20, each separated by a 10° angle, as shown in the enlarged section. The radial ridges of position marker 10 are about 3/16 of an inch in width. At the center of position marker 10 is a marker sequence indicator 30. Position marker 10 is dual sided, with ridges 20 and sequence indicator 30 formed on both top and bottom. Position marker 10 can thus be placed with one side up to indicate a right foot, or with the other side up to indicate a left foot. A cross section taken along line A—A of position marker 10 is shown in FIG. 1B. Position marker 10 has a minimum thickness of about 3/16 of an inch, with the ridges extending about 3/32 of an inch from either side, for a total thickness of about 3/8 of an inch. Radial ridges 20 on the top side of position marker 10 are offset by 5° from the radial ridges 20 on the bottom side of position marker 20, to facilitate a game set of position markers to be stacked on a carrying stand (not shown) through a central hole 40.

The game set of the preferred embodiment includes twenty three sequentially numbered foot position markers and two unnumbered foot position markers. The game method of the preferred embodiment begins with the step of placing the two unnumbered foot position markers on the playing surface, typically outdoors on the ground. The two initial foot position markers are preferably placed so that the first player can comfortably stand on them, such as illustrated in FIG. 2.

Figure 2:
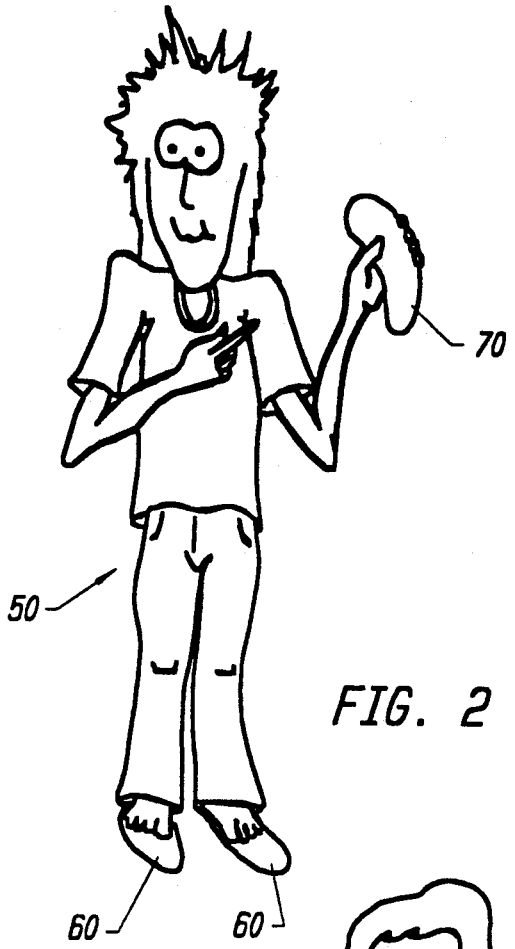
FIG. 2 is a perspective view of a player employing the game method and apparatus of the preferred embodiment at an initial stage of the game.

In FIG. 2, a first player 50 stands on the two blank foot position markers, indicated by reference numeral 60, and holds the first numbered foot position marker 70 in his hand. After standing on the initial trail consisting of markers 60, player 50 places marker 70 as desired. Player 50 must then successfully move onto newly placed marker 70 so as to validate at as an extension of the trail. If player 50 does not successfully validate marker 70, then it is removed, and the next player will attempt to successfully traverse the trail, place position marker 70, and validate it. To successfully move onto a position marker (whether traversing the trail or validating a new marker), a player must step onto the marker and maintain balance, generally for at least a couple of seconds, or as pre-agreed by the players. Fouls, which end a player's turn, include losing balance, stepping anywhere other than on a position marker, stepping on a position marker out of order or without sufficiently covering the position marker (i.e. only partially on the marker or with the incorrect orientation), or touching or grabbing anything with the player's hand. Proper orientation on the marker includes using the foot indicated by the marker, so that a player may be required to hop from one marker to the next. Of course, these rules for fouls may be varied, or others used, however agreed upon by the players.

Figure 3:
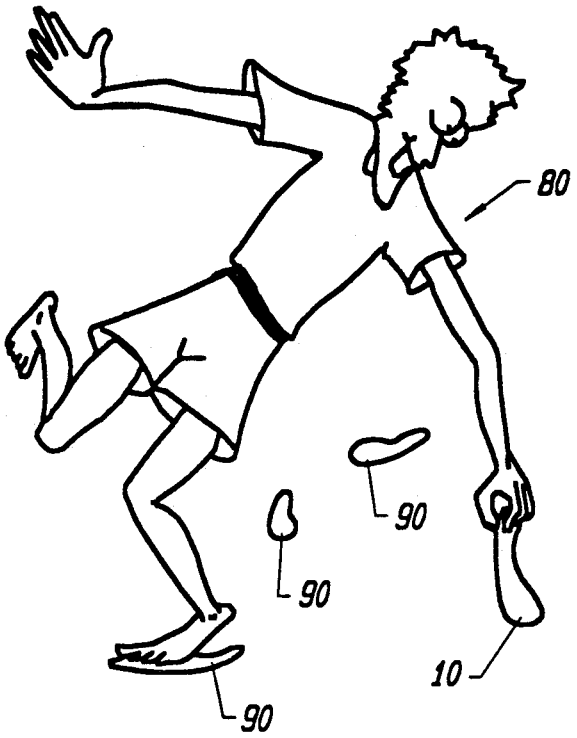
FIG. 3 is a perspective view of a player employing the game method and apparatus of the preferred embodiment at an intermediate stage of the game.

After the first player, play continues in rotation, with each player attempting to successfully traverse the trail and extend it by placing a new marker (in sequence) and validating it. Such an intermediate turn is illustrated in FIG. 3, in which player 80 has successfully traversed the current trail consisting of markers 90. Player 80 is shown in the process of placing a new marker 100, after which he will attempt to successfully move on to it to validate it and thereby extend the trail.

Figure 4:
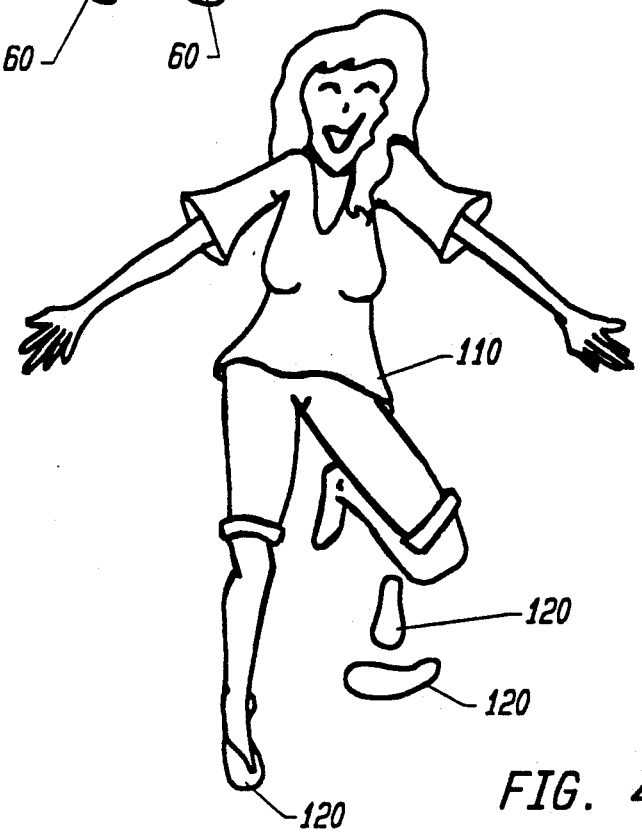
FIG. 4 is a perspective view of a player employing the game method and apparatus of the preferred embodiment at a final stage of the game.

Once all of the position markers of the set have been successfully added to the trail, the trail is complete, turns continue in rotation and the next player to successfully traverse the trail is the winner. Such a turn is shown in FIG. 4, where player 110 has just successfully traversed the complete trail consisting of markers 120, and she is then declared the winner.

A wide variety of alternative rules are possible for the game of the present invention. In one embodiment, if a player loses balance while attempting to traverse the trail, they are declared a loser and are thereafter excluded from further play. In yet another embodiment, position markers are provided to indicate any of the limb extremities: left-hand, right-hand, left-foot, and right-foot. The player must move the indicated limb onto the position marker, and upon successful traversal of the current trail a player may choose to attempt to add either a new foot position marker or a new hand position marker.

In other embodiments, the numbered markers are used for scoring. Points are accrued for successfully placing a position marker; the score received is equal to the sequence number of the position marker. For advanced play, each player's score is adjusted according to an attempt to successfully traverse to completed trail both start to end and then back to the beginning. The score is adjusted by subtracting the value of the last position marker successfully moved onto while returning through the trail; if the player fouls before successfully traversing the trail in the forwards direction, the value of the highest numbered position marker is subtracted.

Additionally, one embodiment is designed for play by the blind, in which each position marker is equipped with a buzzer/noisemaker. The player currently attempting to traverse the trail carries an actuator by which the buzzer of each position marker may be activated in sequence. The player attempts to locate the next position marker and step on it based on the sound from its buzzer. Once the marker is stepped on, its buzzer stops, letting the players know whether they have correctly stepped onto the marker (although a sighted referee might be helpful).

It is to be understood that the above description is intended to be illustrative and not restrictive. Many embodiments will be apparent to those of skill in the art upon reviewing the above description. For instance, the set need not include two blank initial markers; the trail can be begun by the first player. Additionally, the markers could be blank and unsequenced, or they could be sequenced alphabetically. The scope of the invention should, therefore, be determined with reference to the appended claims, along with the full scope of equivalents to which such claims are entitled.

What is claimed is:

1. A game procedure comprising the a) providing a plurality of limb markers;

b) providing an initial trail o position marker upon a playing surface;

c) in rotation among a group of players, enacting a turn for each player so as to incrementally build the trail up to a predetermined number of markers, each turn comprising the steps of i) the player attempting to successfully traverse the trail of position markers by successfully moving onto each position marker of the trail in sequence, ii) if having successfully traversed the trail, placing an new position marker in a position chosen by the player so as to extend the trail, iii) the player validating a new position marker by successfully moving onto the new position marker, otherwise failing to validate the new position marker, and iv) if having failed to validate the new marker, removing the new marker from the trail.

2. The game procedure of claim 1, wherein each limb extremity position marker in the trail indicates a particular limb extremity selected from the group of left-foot, right-foot, left-hand, and right-hand, and wherein the step of attempting to successfully traverse the trail of position markers comprises attempting to successfully move onto each position marker the particular limb extremity indicated by the position marker.

3. The game procedure of claim 1, wherein the step of enacting a turn for each player further comprises ending the turn if the player loses balance and touches a limb extremity to the playing surface, and wherein said game procedure further comprises, after the step of enacting a turn for each player so as to incrementally build the trail up to a complete trail of a predetermined number of markers, the steps of d) in rotation among the group of players, a player attempting to successfully traverse the complete trail of position markers by successfully moving onto each position marker of the trail in sequence; and e) declaring as a winner a first player to successfully traverse the complete trail of position markers.

* * * * *